United States Patent [19]

D'Estaintot

[11] Patent Number: 4,989,395

[45] **Date of Patent: * Feb. 5, 1991**

[54] APPARATUS FOR AUTOMATICALLY DISPENSING BAGS AS ARTICLES ARE LOADED THEREIN AT THE EXIT OF A CHECK-OUT STATION

[75] Inventor: Pierre D'Estaintot, Meudon, France

[73] Assignee: Societe Anonyme Des Marches Usines-Auchan, Villeneuve D'Ascq., France

[ * ] Notice: The portion of the term of this patent subsequent to Sep. 26, 2006 has been disclaimed.

[21] Appl. No.: 392,353

[22] Filed: Aug. 11, 1989

Related U.S. Application Data

[63] Continuation-in-part of Ser. No. 155,801, Feb. 16, 1988, Pat. No. 4,869,045.

[30] Foreign Application Priority Data

Feb. 16, 1987 [FR] France ..... 87 01947

[51] Int. Cl.[5] ..... B65B 43/26; B65B 17/00

[52] U.S. Cl. ..... 53/384; 53/390; 53/572

[58] Field of Search ..... 53/385, 384, 386, 390, 53/391, 459, 571, 572, 573; 186/66; 206/554; 248/100, 95

[56] References Cited

U.S. PATENT DOCUMENTS

| | | | |
|---|---|---|---|
| 1,794,517 | 3/1931 | Hellman | 53/385 |
| 2,790,591 | 4/1957 | Rosen | 53/572 X |
| 2,843,988 | 7/1958 | Thompson et al. | 53/572 X |
| 3,138,907 | 6/1964 | Gerbe | 53/385 |
| 3,439,891 | 4/1969 | Pinto | 248/100 |
| 3,973,376 | 8/1976 | Suominen | 53/385 |
| 4,869,045 | 9/1989 | D'Estaintot | 53/384 |

FOREIGN PATENT DOCUMENTS

| | | | |
|---|---|---|---|
| 270432 | 4/1964 | Australia | 248/100 |

*Primary Examiner*—Robert L. Spruill
*Assistant Examiner*—Beth Bianca
*Attorney, Agent, or Firm*—Fisher, Christen & Sabol

[57] ABSTRACT

A device is provided for packing in supple bags articles billed individually at a check-out desk of a self-service store. The device includes: two slightly inclined rods; a reserve of supple bags suspended vertically from said rods via handles; means for evacuating these bags once filled; wherein the terminal part of each of the suspension rods, towards the free end thereof, presents a surface state different from the preceding part of the rod and such that the coefficient of friction of this terminal part is greater than that of the preceding part of the rod, with the result that the resistance to slide of the handles on this terminal part of the rods becomes greater than the previous resistance to slide, thus allowing, by the force of retention thus employed, the rupture of the separable point of connection between the rear face of the evacuated filled bag and the front face of the following empty bag pulled towards its position for filling.

11 Claims, 2 Drawing Sheets

APPARATUS FOR AUTOMATICALLY DISPENSING BAGS AS ARTICLES ARE LOADED THEREIN AT THE EXIT OF A CHECK-OUT STATION

BACKGROUND OF THE INVENTION

The present application is a continuation-in-part of U.S. patent application Ser. No. 155,801, filed Feb. 16, 1988, now U.S. Pat. No. 4,869,045, issued Sept. 26, 1989.

The present invention relates to a device essentially intended to equip an exit station, and in particular a check-out desk for billing articles purchased in a self-service store, which device makes it easier for the staff to pack the articles in bags at the same time as billing the purchases.

Applicants, prior patent application discloses a device equipping an exit station of a store, particularly of a self-service supermarket, in which the articles are packed in bags at the checkout desk.

The device according to applicant's prior U.S. patent application Ser. No. 155,801 (which is hereby incorporated by reference in its entirety) comprises, on the one hand, a reserve of bags stacked vertically, the top of each bag comprising handles for holding and each face of a bag is detachably fast with the face thereopposite, belonging to the adjacent bag, and the device further comprises two parallel rods for suspension, inserted in perforations made in the handles of the bag so as to maintain all the bags stacked in reserve on the one hand and, on the other hand, to allow displacement of the bag from a standby position at the front of the reserve towards an active position in which it is open and gaping to receive the billed articles.

This prior application provides more particularly that the two rods be inclined so as to facilitate the slide of the bag from its standby position to its active position.

In the device provided in applicant's prior application, mechanical means for evacuating the bags are provided so as to allow the full bag to be evacuated at the same time as automatically pulling the following bag into standby position, thanks to the point of connection of one bag on the following.

U.S. Pat. No. 4,291,517 also discloses a device of this type in which the bags are stacked in standby and are suspended by their handles (perforated to that end) on two rods likewise inclined towards their free end to facilitate slide of each bag from its standby position towards an active position for filling; however, this U.S. Patent does not provide an automatic evacuation system, with the result that the bags must be moved from the standby position towards the active position by hand, and the bag once filled must likewise be evacuated by hand.

SUMMARY OF THE INVENTION

It is an object of the present application to further develop the possibilities of the device as provided in the parent application.

To that end, the invention relates to a device provided for packing in supple bags articles billed individually at a check-out desk of a self-service store, of the type comprising:

(a) two rods slightly inclined with respect to the horizontal towards their free end, the starting end of each rod being connected to a support wall;

(b) a reserve of supple bags disposed vertically with respect to the rods, the bags being provided with handles for holding, each face of a bag being joined to the face thereopposite of the adjacent bag by at least one point of connection provided to yield beyond a determined pulling force, each bag thus being adapted to be displaced from a standby position at the front of the reserve towards an active position for filling, towards the free end of the rods;

(c) means for displacing these bags once filled and adapted to cause evacuation of the filled bag from its position of filling towards an exit station where it may be taken manually, the evacuation of the filled bag by said displacement means pulling the following bag from the reserve via the, or each, separable point of connection, the device being characterized in that the terminal part of each of the suspension rods, towards the free end thereof, presents a surface state different from the preceding part of the rod and such that the coefficient of friction of this terminal part is greater than that of the preceding part of the rod, with the result that the resistance to sliding of the handles on this terminal part of the rods becomes greater than the previous resistance to sliding, thus causing, by the force of retention thus generated, the rupture of the separable point of connection between the rear face of the evacuated filled bag and the front face of the following empty bag as it is pulled towards its position for filling.

According to a more particular feature, the two inclined rods each present a notch near their free end, these notches being disposed in the same transverse plane, the notches being adapted to give an increased resistance to slide of the handles of the bag beyond said notch.

More especially, the two notches are disposed on the upwardly oriented faces of each of the two rods.

According to a variant, the terminal part of the two rods comprises at least on its upwardly oriented face a surface state presenting a coefficient of friction greater than that of the preceding part of the rods.

According to another variant, the terminal part of the two rods comprises, at least on the upwardly oriented part of these rods, a coating of material presenting a coefficient of friction greater than that of the preceding, non-coated part of the rods.

According to a more particular embodiment, the terminal part of the rods comprises surface roughness thus increasing the coefficient of friction of the handles of the bags when they reach said part, whilst the preceding part offers a smooth, polished surface.

Said surface roughness is advantageously constituted by notches or parts in relief.

According to another feature of the device of the present application, the means for evacuating the filled bags are constituted by motorized rollers which move the bag resting by gravity on the rollers from the filling station towards the terminal evacuation station.

According to another feature, the device comprises means for retaining the stack of reserve bags, constituted by a locking pin inserted in a lug integral with the upper wall of the stacked bags, this lug being provided to be easily separable from the rest of the bag by a line of weakness adapted to yield as soon as a traction is exerted on the bag.

Finally, according to a more particular feature, the upper part of the rods for suspending the bags comprises, near its point of connection on a fixed wall, a horizontal part adapted to receive and suspend the stack of reserve bags.

BRIEF DESCRIPTION OF THE DRAWING FIGURES

The invention will be more readily understood on reading the following description with reference to the accompanying drawings, in which:

FIGS. 1*a*, 1*b*, 1*c* and 1*d* show views in side elevation of the device of the invention, illustrating the successive phases of filling, then of evacuation, of the bags, with pulling of the subsequent bag.

FIG. 2 shows a view in perspective of a bag being filled.

FIGS. 3*a*, 3*b* and 3*c* show three variant embodiments of the end of the rods for suspending the bags.

DETAILED DESCRIPTION OF THE PREFERRED EMBODIMENTS

Figure 2:
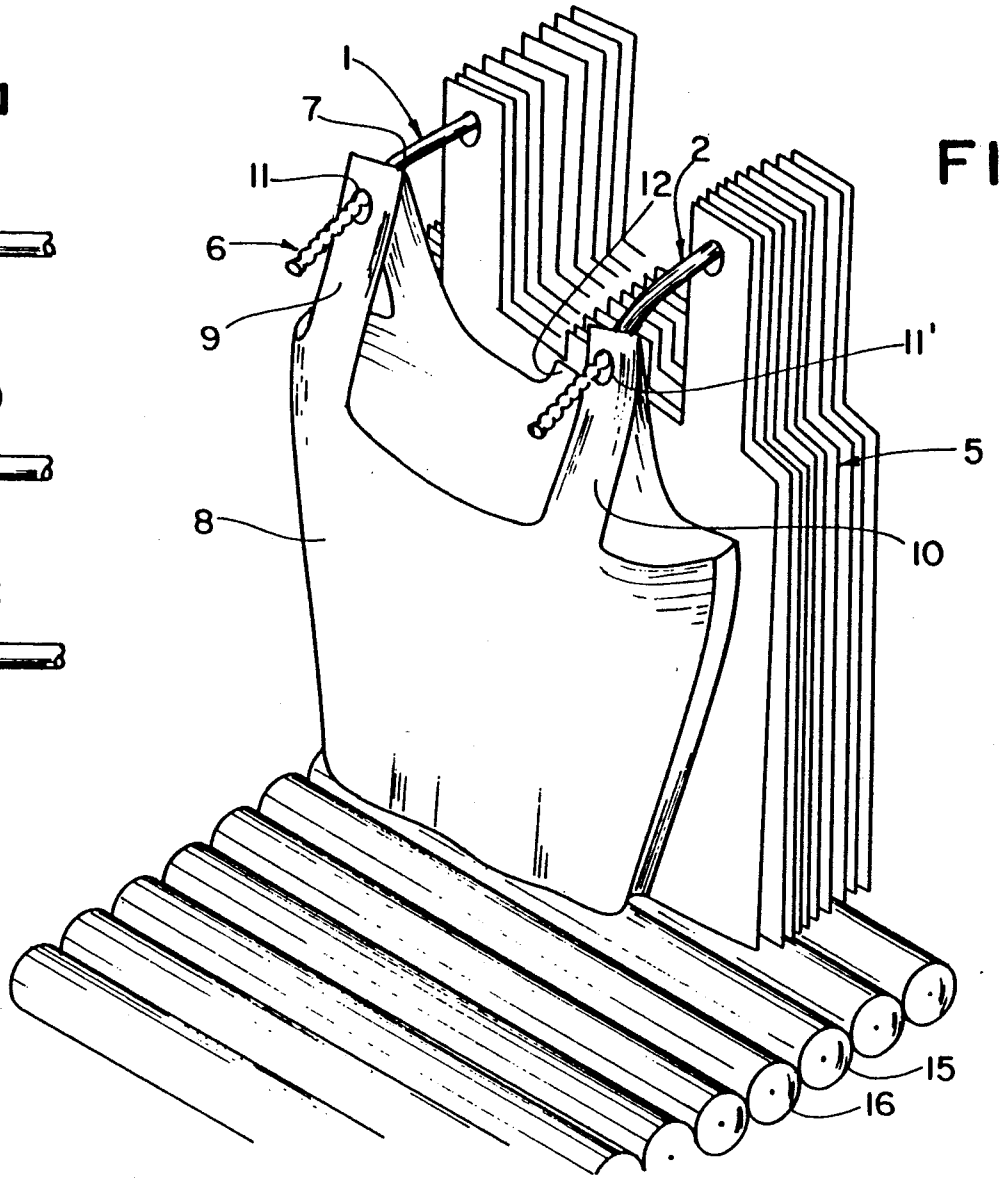

Referring now to the drawings, the Figures show the device for equipping the billing station or checkout desk of a self-service store (in accordance with FIG. 2 of applicant's prior application).

The device comprises two twinned rods 1 and 2 (FIG. 2) as described in applicant's prior application. These two rods 1 and 2 are joined at their start to a support wall 3 or to any support. Their starting or upper part 4 is horizontal so as to receive the stack of bags 5 in reserve.

Figure 1A:
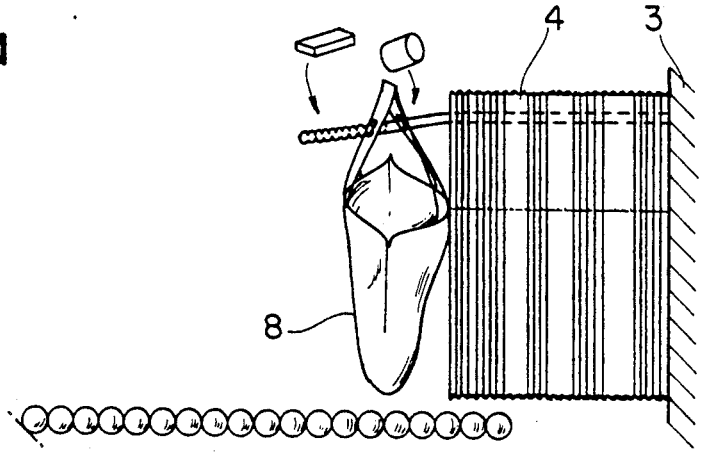
Figure 1B:
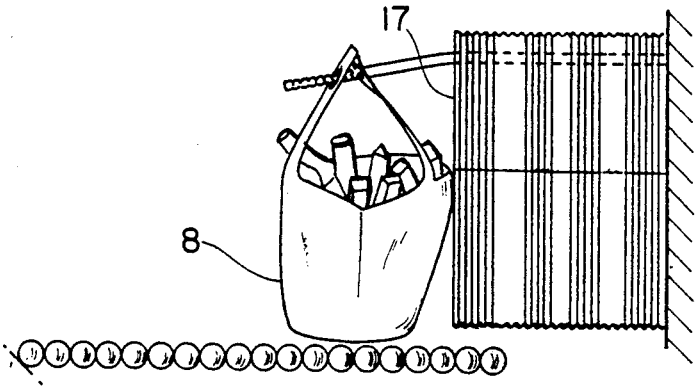

Part 7 of each rod 1 and 2, located towards the free end 6 of the rods, is slightly inclined downwardly with respect to the horizontal so as to allow the bags to slide from the reserve 5 towards the active position for filling, such as bag 8 shown in FIGS. 1*a*, 1*b* and 2.

Each bag belonging to the reserve comprises two upper handles for holding, 9 and 10 respectively, which are engaged via an opening 11, 11' on the rods 1 and 2 and in particular on the horizontal part 4 thereof to constitute the reserve of standby bags.

Each of the bags respectively comprises two faces, a front face and a rear face, each being connected to handles 9 and 10 for suspension and each face of one bag is joined to the face lying thereopposite of the adjacent bag by a separable point of connection, as described in the parent application and likewise provided in U.S. Pat. No. 4,291,517 mentioned hereinbefore.

Furthermore, the bags are maintained stacked in reserve by a lobe element 12 integral with the upper edge of the bag and engaged on a retaining pin, as described and shown in the parent application.

According to a feature of the present invention, the end of the rods 1 and 2, in their inclined part 7, terminates in a zone presenting a surface state adapted to generate an increased friction of the handles 9 and 10 of the bag when it slides along the inclined part 7 of the rods.

Figure 3A:
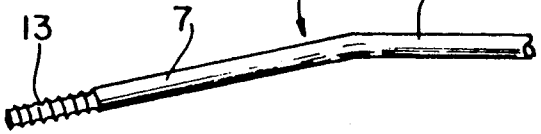
Figure 3B:
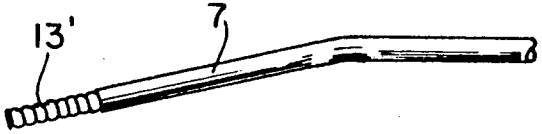
Figure 3C:
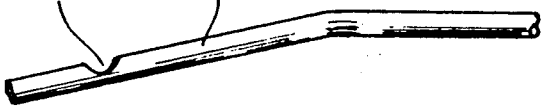

As shown in FIGS. 3*a*, 3*b* and 3*c*, these means adapted to increase the forces of friction encountered by the handles 9 and 10 sliding on part 7 of the rods, are constituted by surface roughness, in the form of notches or parts in relief 13 in FIG. 3*a*.

FIG. 3*b* shows a rod whose terminal part comprises a coating 13' whose coefficient of friction is greater than the previous part of the rod; for example, this terminal part 13' is constituted by an elastomer resin such as rubber and it is mounted on the end of the rod of which the previous part is made of polished or chrome-plated metal, consequently presenting a much lower coefficient of friction than the rubber-coated terminal part 13'.

In FIG. 3*c*, the inclined terminal part of rod 7 comprises a notch 14.

The device operates in the same manner as described in the parent application.

Bag 8 once filled, according to FIG. 1*b*, may be displaced by evacuation means here constituted by a series of motorized rollers 15, 16.

Figure 1C:
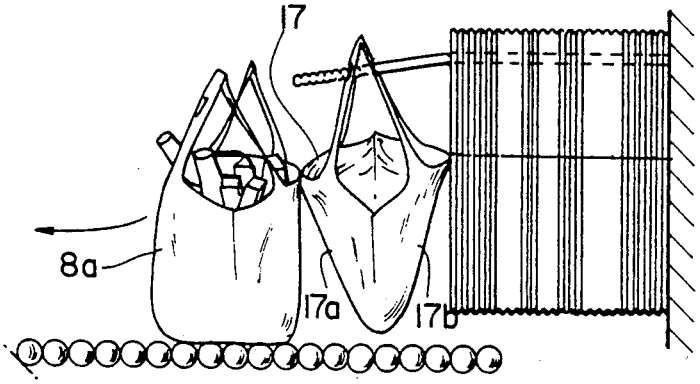

Bag 8 according to FIG. 1*b* or 1*c*, once filled, rests by its bottom on the evacuation means, namely the rollers, with the result that the weight of the bag resting on the rollers automatically brings about, upon motorized rotation of the rollers, the displacement of the bag in the direction of the arrow in FIG. 1*c*.

In this movement of evacuation, the bag 8 moving in the direction of the arrow automatically pulls the following bag, namely bag 17 which was previously in standby position at the front of the reserve, according to FIG. 1*b*.

In fact, the opposite faces 8*a* and 17*a* (FIG. 1*c*) of the two bags are still joined by a point of connection, for example a spot of glue or a bridge of material.

This point of connection is strictly calibrated so as to yield beyond a certain force of traction.

When the handles 10*a* of bag 17 reach the terminal zone 13 of rod 7, they no longer slide easily on the rod due to the increased resistance furnished by the surface state of this terminal part.

This terminal part may be constituted by a coating with a high coefficient of friction, by notches or by one notch, as illustrated in FIGS. 3*a*, 3*b* and 3*c*.

The empty bag 17 which is still being pulled by the full bag (the latter being evacuated by the rollers) tends, in fact, since it is retained by its other face 17*b* remaining fast with the rest of the reserve, to be applied on the rod and therefore to be braked by the terminal part thereof presenting a high coefficient of friction.

On the contrary, bag 8 presents a certain rigidity, since it is filled with solid articles; it is advanced by the rollers and, as the terminal part of the rods is still inclined, the full bag borne by the rollers and therefore only slightly supported by the end of the rod, may easily be disconnected from this end and continue its path, with the result that the friction of the terminal part of the rod will only slightly brake the filled bag and will not oppose evacuation thereof, whilst it will considerably brake the subsequent movement of slide of the arriving empty bag 17.

The empty bag being braked, and the full bag being for its part driven by the rollers, this results in an increasing traction between the opposite faces 17*a* and 8*a* of bags 8 and 17 until the point of connection yields.

In the subsequent phase, the full bag 8 may therefore be conducted towards the exit, whilst the empty bag 17 remains in position at the filling station.

Figure 1D:
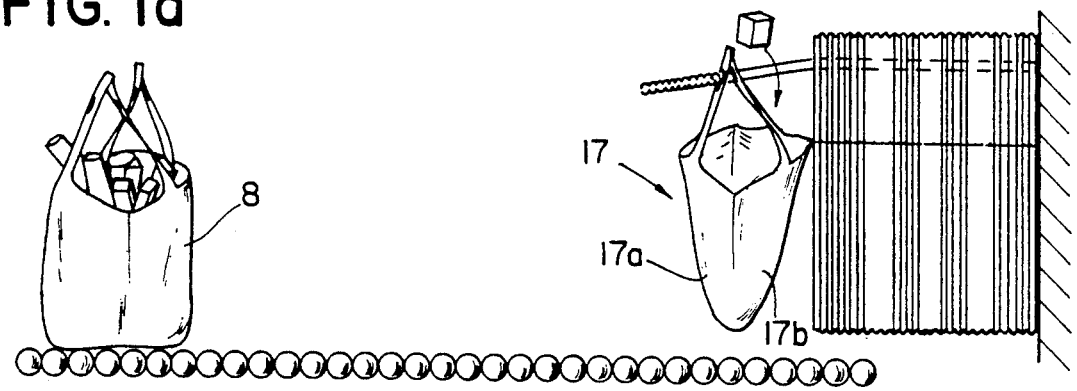

FIG. 1*d* shows that the front face 17*a* of bag 17 is thus separated from the rear face 17*b* thereof, which has remained fast with the subsequent bag.

The new bag therefore automatically lies in position for filling, without any manual intervention.

What is claimed is:

1. A device for packing in supple bags articles billed individually at a check-out desk of a self-service store, of the type comprising:

(a) two rods slightly inclined with respect to the horizontal towards their free end, the starting end of each rod being connected to a support wall;

(b) a reserve of supple bags disposed vertically with respect to the rods, the bags being provided with handles for holding, each face of a bag being joined to the face thereopposite of the adjacent bag by at least one point of connection provided to yield beyond a determined pulling force, each bag thus being adapted to be displaced from a standby position at the front of the reserve towards an active position for filling, towards the free end of the rods;

(c) means for displacing these bags once filled and adapted to cause evacuation of the filled bag from its position of filling towards an exit station where it may be taken manually, the evacuation of the filled bag by said displacement means pulling the following bag from the reserve via the, or each, separable point of connection, the terminal part of each of the suspension rods, toward the free end thereof, presents a surface state different from the preceding part of the rod and such that the coefficient of friction of this terminal part is greater than that of the preceding part of the rod, with the result that the resistance to slide of the handles on this terminal part of the rods becomes greater than the previous resistance to slide, thus allowing, by the force of retention thus employed, the rupture of the separable point of connection between the rear face of the evacuated filled bag and the front face of the following empty bag pulled towards its position for filling.

2. The device of claim 1, wherein the two inclined rods each present a notch near their free end, these notches being disposed in the same transverse plane, the notches being adapted to give an increased resistance to slide of the handles of the bag beyond said notch.

3. The device of claim 2, wherein the two notches are disposed on the upwardly oriented faces of each of the two rods.

4. The device of claim 1, wherein the terminal part of the two rods comprises at least on its upwardly oriented face a surface state presenting a coefficient of friction greater than that of the preceding part of the rods.

5. The device of claim 4, wherein the terminal part of the two rods comprises, at least on the upwardly oriented part of these rods, a coating of material presenting a coefficient of friction greater than that of the preceding, non-coated part of the rods.

6. The device of claim 4, wherein the terminal part of the rods comprises surface roughness thus increasing the coefficient of friction of the handles of the bags when they reach said part, whilst the preceding part offers a smooth, polished surface.

7. The device of claim 6, wherein said surface roughness is advantageously constituted by notches or parts in relief.

8. The device of claim 1, wherein the means for evacuating the filled bags are constituted by motorized rollers which move the bag resting by gravity on the rollers from the filling station towards the terminal evacuation station.

9. The device of claim 1, further comprising means for retaining the stack of reserve bags, constituted by a locking pin inserted in a lug integral with the upper wall of the stacked bags, this lug being provided to be easily separable from the rest of the bag by a line of weakness adapted to yield as soon as a traction is exerted on the bag.

10. The device of claim 1, wherein the upper part of the rods for suspending the bags comprises, near its point of connection on a fixed wall, a horizontal part adapted to receive and suspend the stack of reserve bags.

11. A device for facilitating the loading of articles into bags at a check-out desk of a store, comprising:

(a) a support wall;

(b) at least two rods, the first ends of said rods being attached to said support wall, the portions of said rods in proximity with said first ends being substantially horizontal, the portions of said rods in proximity with the second ends of said rods being downwardly inclined, the portions of said rods nearest said second ends further including means for providing increased resistance to the movement of said bags along said rods;

(c) means for moving said bags off of and away from said rods; and (d) a plurality of bags, said bags having handles with apertures disposed therein, whereby said bags may be loaded onto said rods and whereby said bags may rest immobile on said substantially horizontal portions of said rods, said bags including means for joining the rear face of a preceding bag with the front face of a succeeding bag, whereby as said preceding bag moves down said downwardly inclined portions of said rods, said succeeding bag will be pulled open by said preceding bag, but whereby when said succeeding bag reaches said portions of said rods providing increased resistance to the movement of said bags, said means for joining said bags together will rupture, whereby said preceding bag will be transported away and whereby said succeeding bag will remain open on said rods.

* * * * *